US007832051B2

(12) United States Patent
Prieur

(10) Patent No.: US 7,832,051 B2
(45) Date of Patent: Nov. 16, 2010

(54) DOOR STOP WITH INDETERMINATE RETAINING POSITIONS

(76) Inventor: Andre Prieur, 27, rue Raymond Ridel, La Garenne Colombes (FR) 92250

( * ) Notice: Subject to any disclaimer, the term of this patent is extended or adjusted under 35 U.S.C. 154(b) by 108 days.

(21) Appl. No.: 11/996,859

(22) PCT Filed: Jul. 17, 2006

(86) PCT No.: PCT/FR2006/001741

§ 371 (c)(1),
(2), (4) Date: Jan. 25, 2008

(87) PCT Pub. No.: WO2007/012729

PCT Pub. Date: Feb. 1, 2007

(65) Prior Publication Data

US 2008/0169659 A1 Jul. 17, 2008

(30) Foreign Application Priority Data

Jul. 27, 2005 (FR) ..... 05 08006

(51) Int. Cl.
*E05F 5/06* (2006.01)

(52) U.S. Cl. ..... 16/85; 16/86 R; 16/86 A; 16/86 B; 16/82

(58) Field of Classification Search ..... 16/85, 16/72, 86 A–86 C, 82, 334, 331, 332, 101; 296/146.9, 146.11, 146.12, 155; 277/634, 277/635, 936, 921, 275, 262, 73, 75, DIG. 19; 292/275, 278, 300, 304, 306, DIG. 15, 340, 292/266, 201, 216; 49/394
See application file for complete search history.

(56) References Cited

U.S. PATENT DOCUMENTS

| | | | | |
|---|---|---|---|---|
| 2,980,945 | A * | 4/1961 | Hollar, Jr. | 16/85 |
| 5,474,344 | A * | 12/1995 | Lee | 292/262 |
| 6,370,732 | B1 * | 4/2002 | Yezersky et al. | 16/85 |
| 6,370,733 | B2 * | 4/2002 | Paton et al. | 16/86 C |
| 6,467,126 | B1 | 10/2002 | Yezersky et al. | |
| 6,513,193 | B1 * | 2/2003 | Yezersky et al. | 16/86 C |
| 6,901,630 | B2 * | 6/2005 | Liang et al. | 16/82 |
| 2001/0016965 | A1 * | 8/2001 | Paton et al. | 16/85 |
| 2003/0163895 | A1 * | 9/2003 | Liang et al. | 16/82 |
| 2004/0251696 | A1 * | 12/2004 | Murayama et al. | 292/262 |
| 2008/0066259 | A1 | 3/2008 | Prieur | |

* cited by examiner

*Primary Examiner*—Victor Batson
*Assistant Examiner*—Emily M Morgan
(74) *Attorney, Agent, or Firm*—Oblon, Spivak, McClelland, Maier & Neustadt, L.L.P.

(57) ABSTRACT

A door check mechanism which provides infinite stable retaining positions for a motor vehicle includes an articulated guided arm mounted to one of the vehicle body or the door and a mechanism mounted on the other of the vehicle body or the door such that the guiding arm penetrates the mechanism with a relative displacement between the two parts. A wedging function results from a blocking of the guiding arm by the mechanism. The mechanism includes a carriage device with a braking roller held in contact with the guiding arm and a braking element to ensure the wedging function. When a load greater than a predetermined value is exerted on the door, an axle of the roller slides along lateral guiding slots until the roller is released from the braking element, thus allowing free rotation of the roller and releases the mechanism.

7 Claims, 13 Drawing Sheets

DOOR STOP WITH INDETERMINATE RETAINING POSITIONS

The present invention relates to a mechanism allowing to hold an articulating or sliding door in an infinite number of stable positions, between fully open and closed positions, with applications more specifically in the area of motor vehicles. This mechanism, intended to be cost effective, comprises a carriage assembly mounted to the door or to the vehicle body, the said carriage includes a braking element in contact with a cylindrical roller, which act as a wedging device in cooperation with an articulated arm, the said arm being mounted to the other part, either the vehicle body or the door. The whole mechanism allows to hold the door open in any intermediate stable position, as soon as the required opening or closing force has ceased.

Some conventional door check mechanisms are known as a result of the present art, like the door check described in patent EP 1 249 569 A1, which comprises on the one hand an articulated arm connected to one part, the said arm being formed to include notches at predefined locations; on the other hand, rollers connected to the other part and urged by a spring inside the notches to provide stable positions.

Such mechanisms have a disadvantage to allow only a limited number of predefined stable door opened positions, with a dragging effect near each of these positions, imposing to hold the door when there is a risk to interfere with an object besides the door, like a pillar, a wall, or another vehicle. Such an operation may even become hazardous if a passenger, while getting out of the vehicle, does not hold the door due to the inconvenient position, and is hurt by a rebound of the said door.

A door check mechanism described in French patent request number 04 08 669, submitted on Aug. 5, 2004 by the present inventor, allows to overcome this disadvantage by providing a possibility to hold the door in an indeterminate retaining position.

The present invention is also intended to overcome the disadvantage caused by traditional door stop mechanisms which have predefined retaining positions, by providing a simple mechanism which allows to hold a door in an infinite number of stable positions, without excluding some preferred predefined positions.

Schematic drawings are enclosed to describe the principles according to which the mechanism proposed by the invention can be realized and how it operates.

Figure 1:
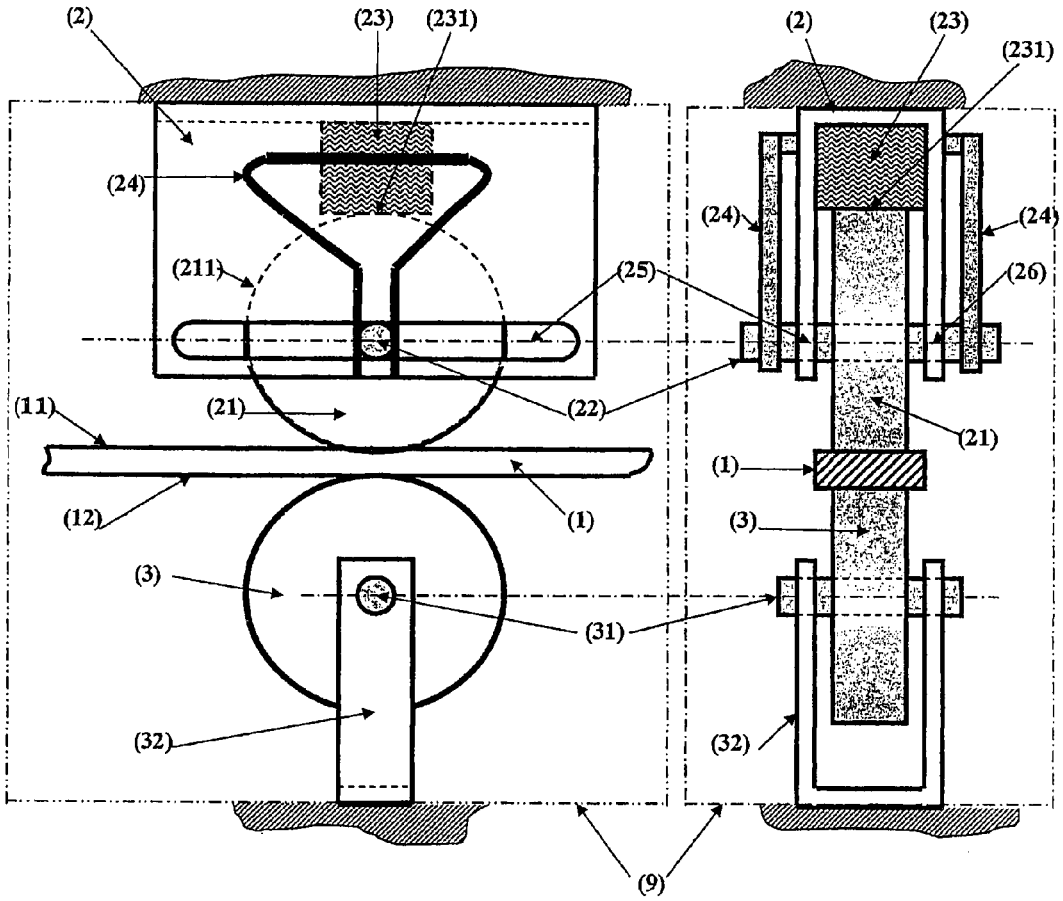

FIG. 1: general schematic view of the mechanism proposed by the invention

Figure 2:
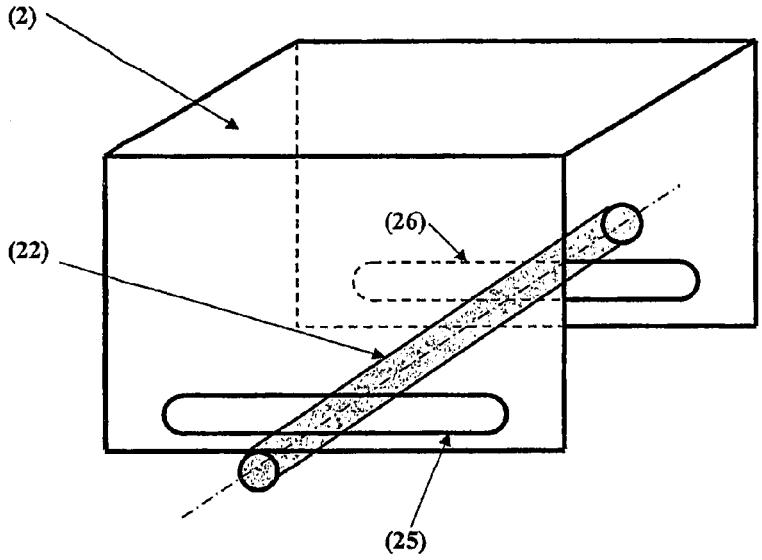

FIG. 2: body of the roller's carriage device (2)

Figure 3:
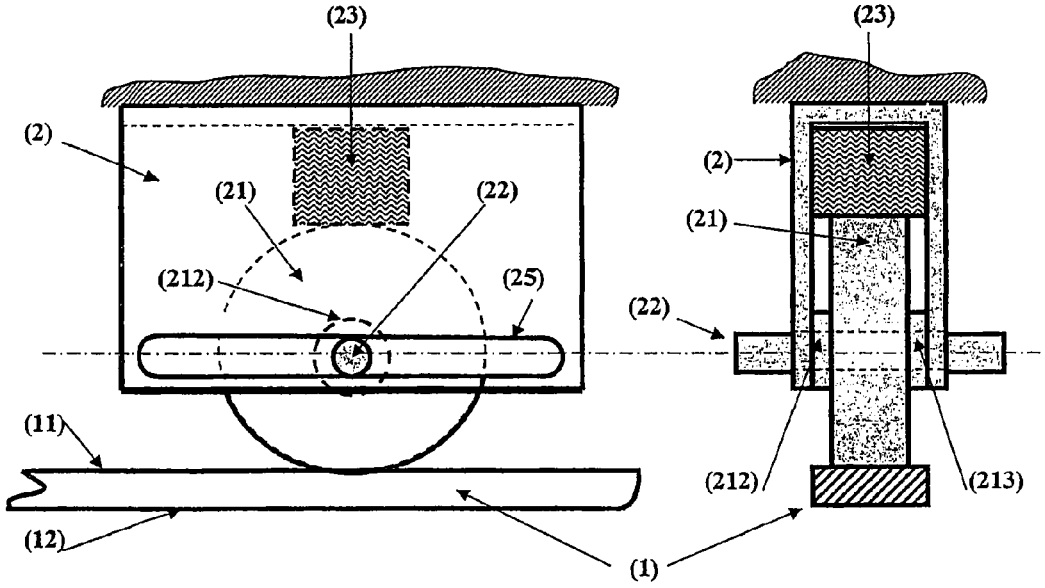

FIG. 3 optional lateral pads (212) and (213) on roller (21)

Figure 4:
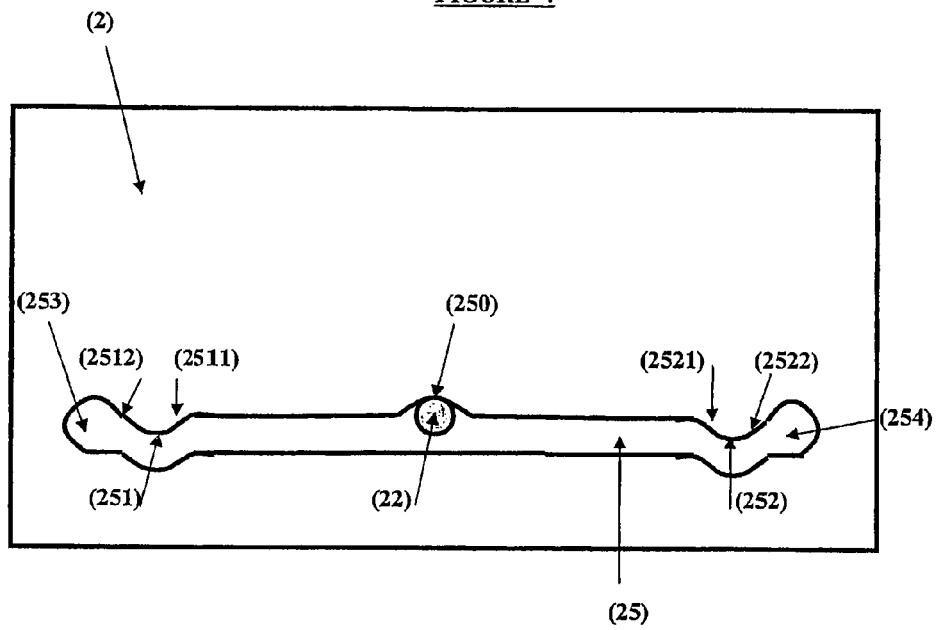
Figure 4:
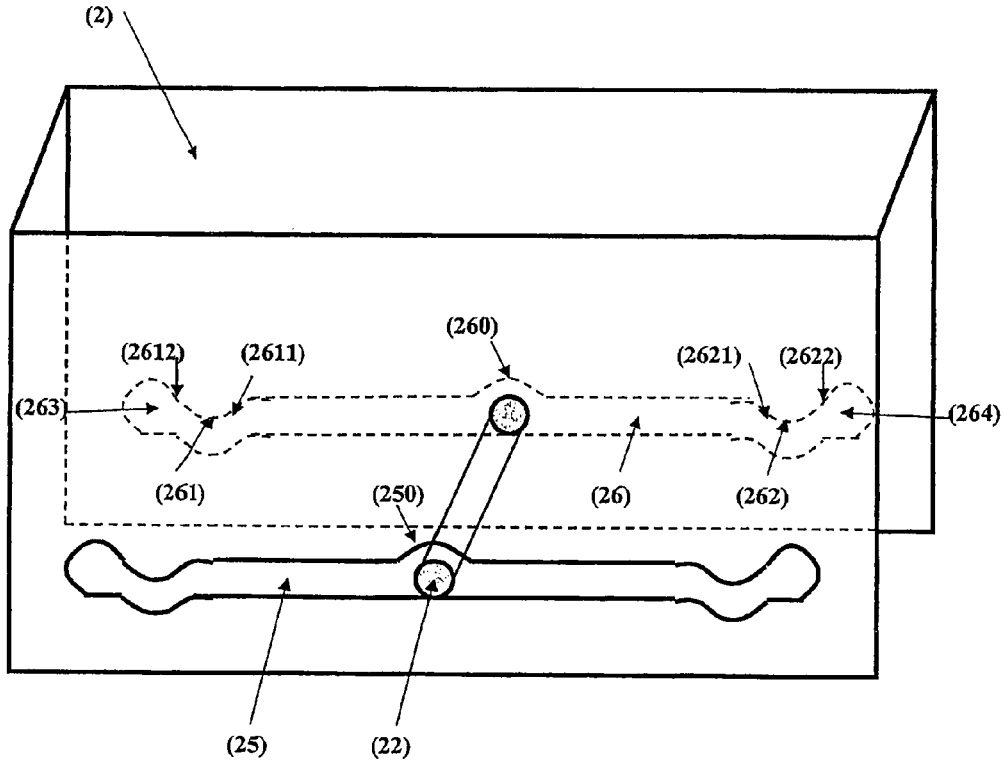

FIG. 4: schematic shapes of the lateral guiding slots

Figure 5:
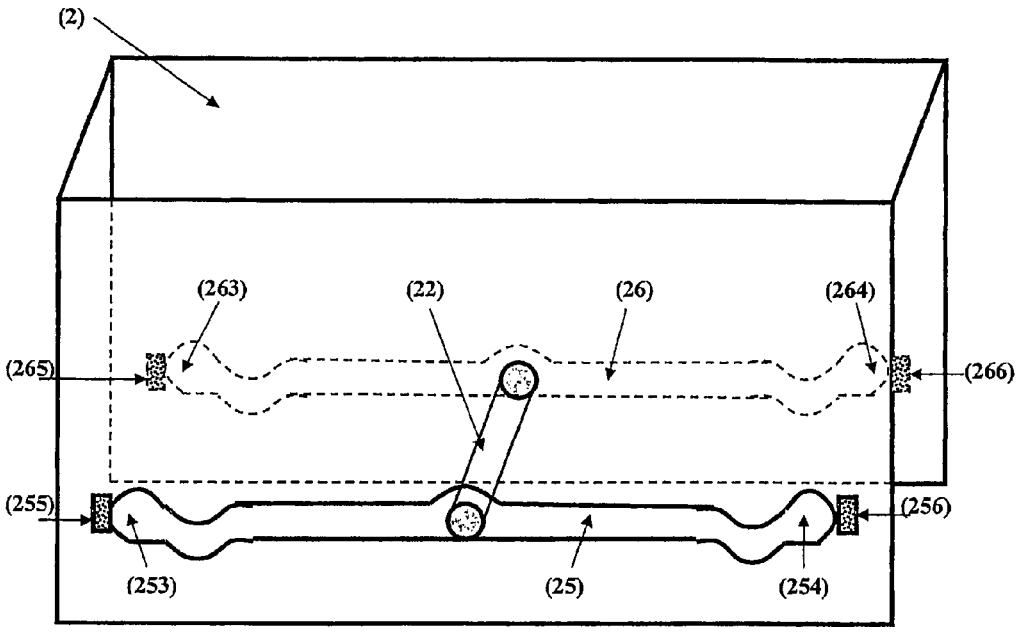
Figure 6:
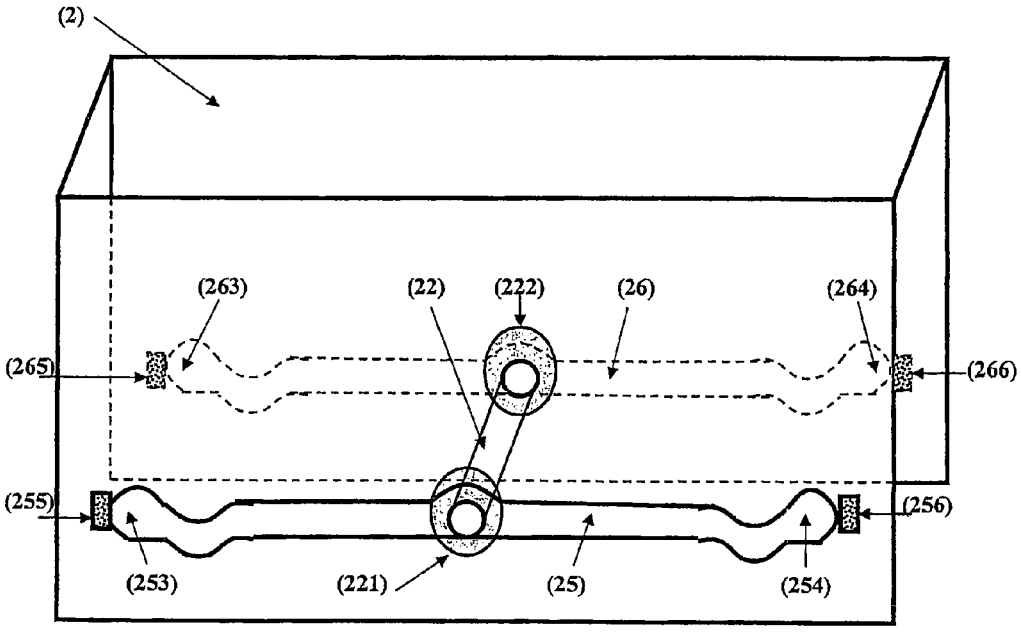

FIG. 5: schematic drawing showing magnets intended to contribute to stabilize axle (22) during opening or closing maneuvers FIG. 6: schematic drawing showing parts having magnetic properties located at the ends of axle (22)

Figure 7:
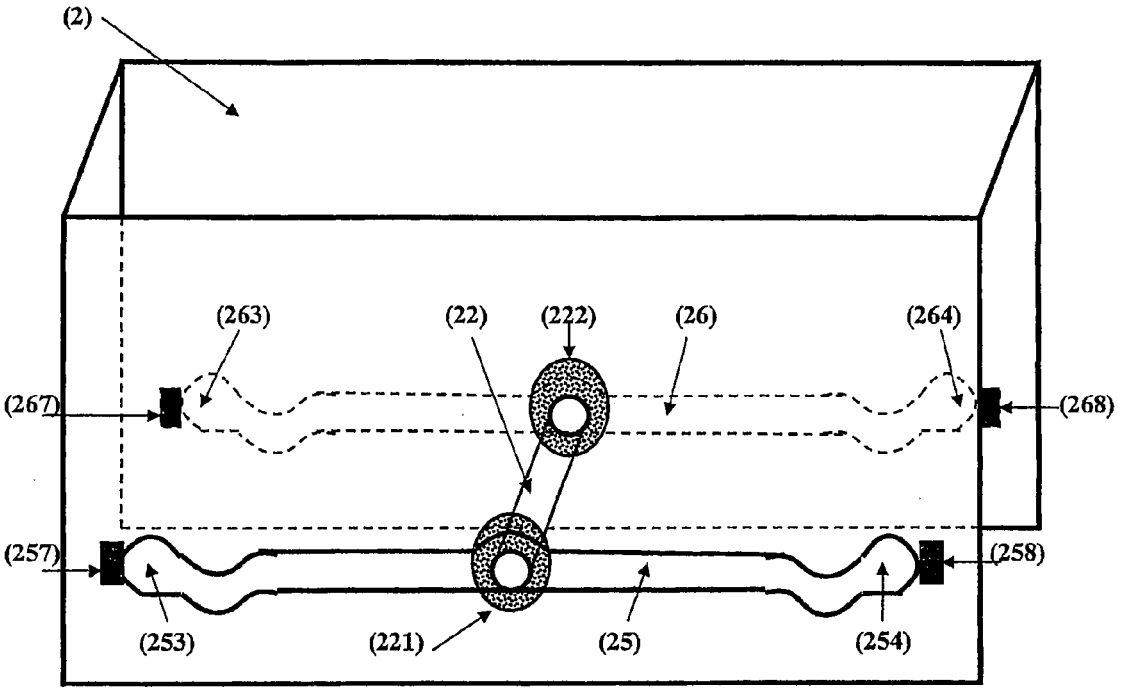

FIG. 7: schematic drawing showing magnetic parts located at the ends of axle (22)

Figure 8:
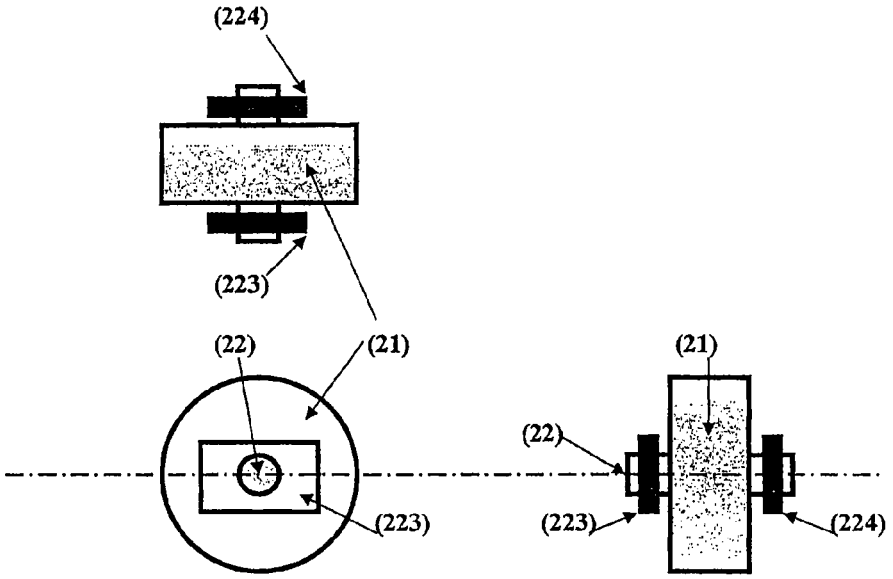

FIG. 8: schematic drawing showing sliding blocks located at the ends of axle (22)

Figure 9:
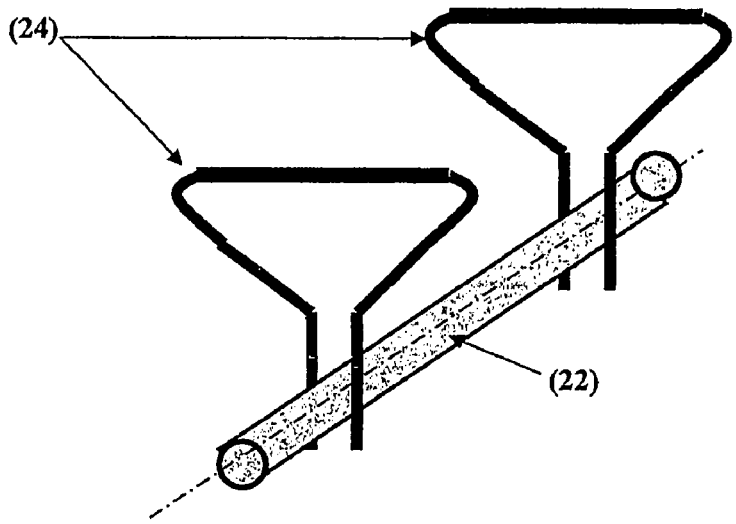

FIG. 9: schematic drawing showing spring device (24)

Figure 10:
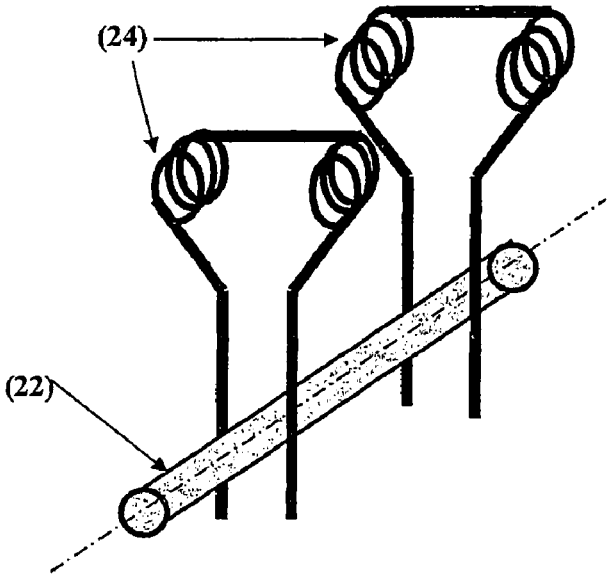

FIG. 10: variation of spring device (24)

Figure 11:
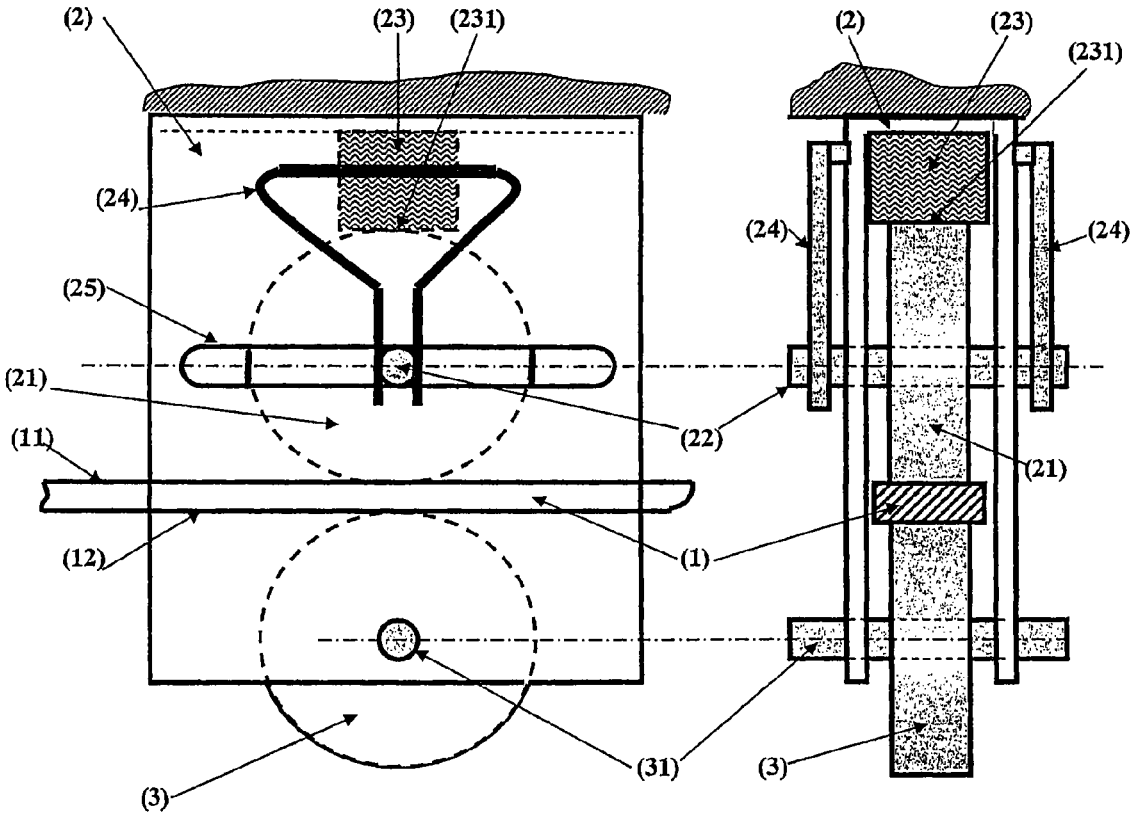

FIG. 11: variation of the mechanism where roller (3) is directly linked to carriage device (2)

Figure 12:
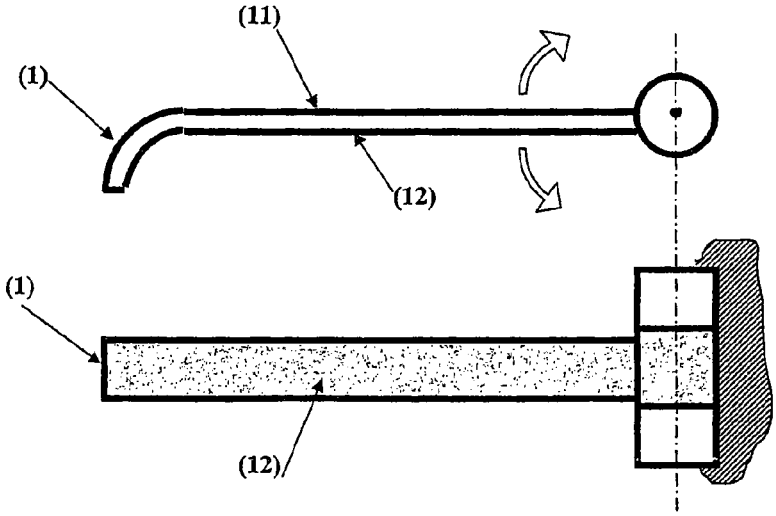

FIG. 12: schematic drawing showing guiding arm (1)

Figure 13:
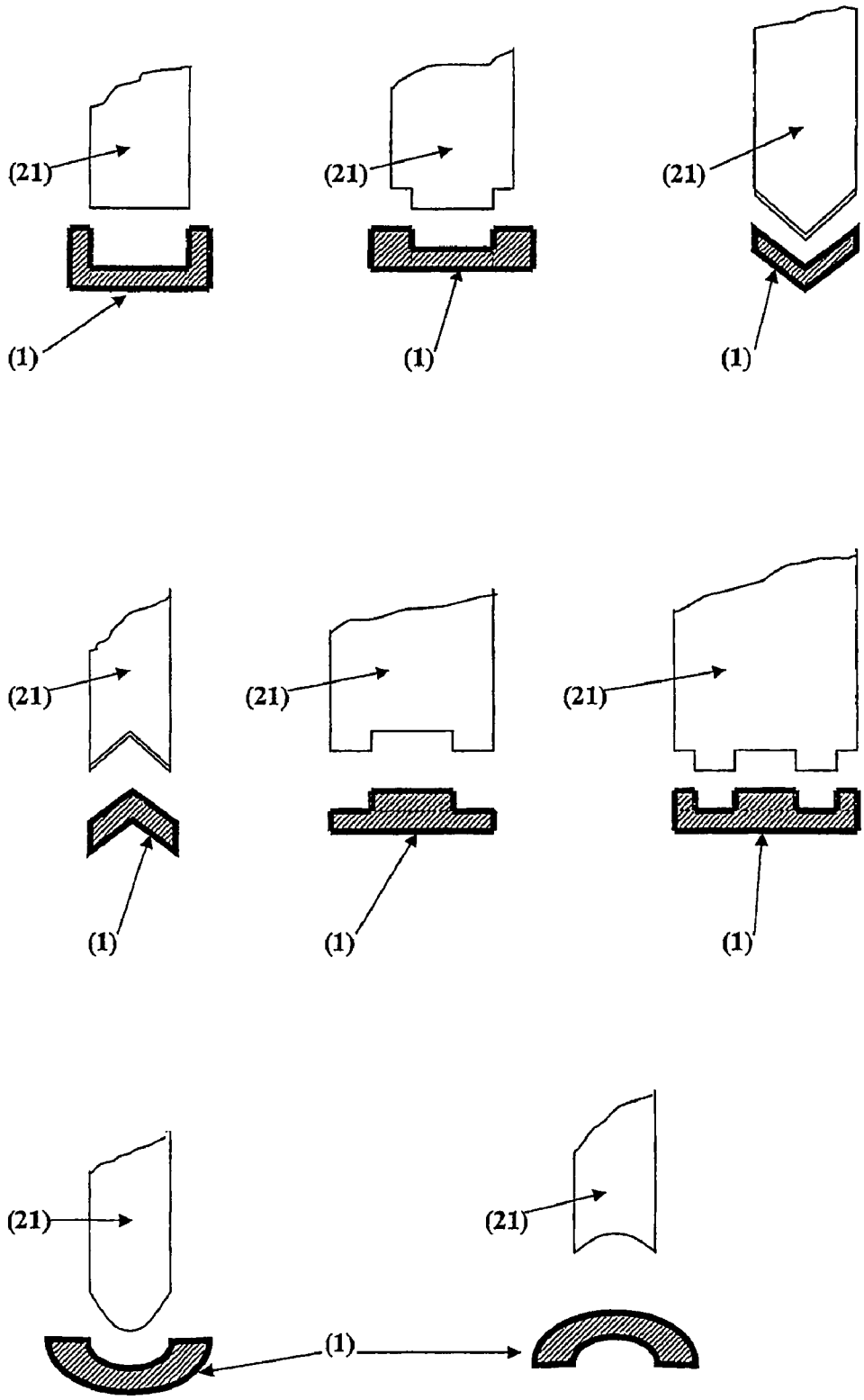

FIG. 13: examples of possible shapes for the cross section of guiding arm (1) and the corresponding profile of roller (21)

Figure 14:
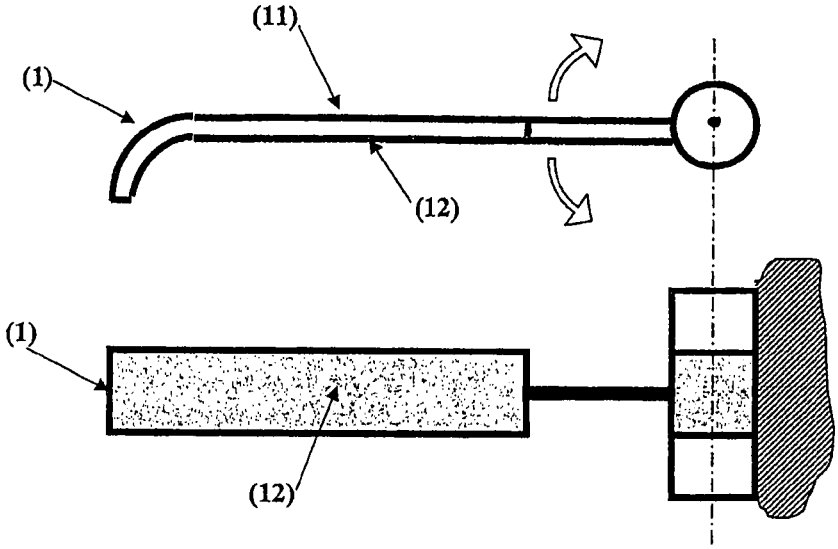
Figure 15:
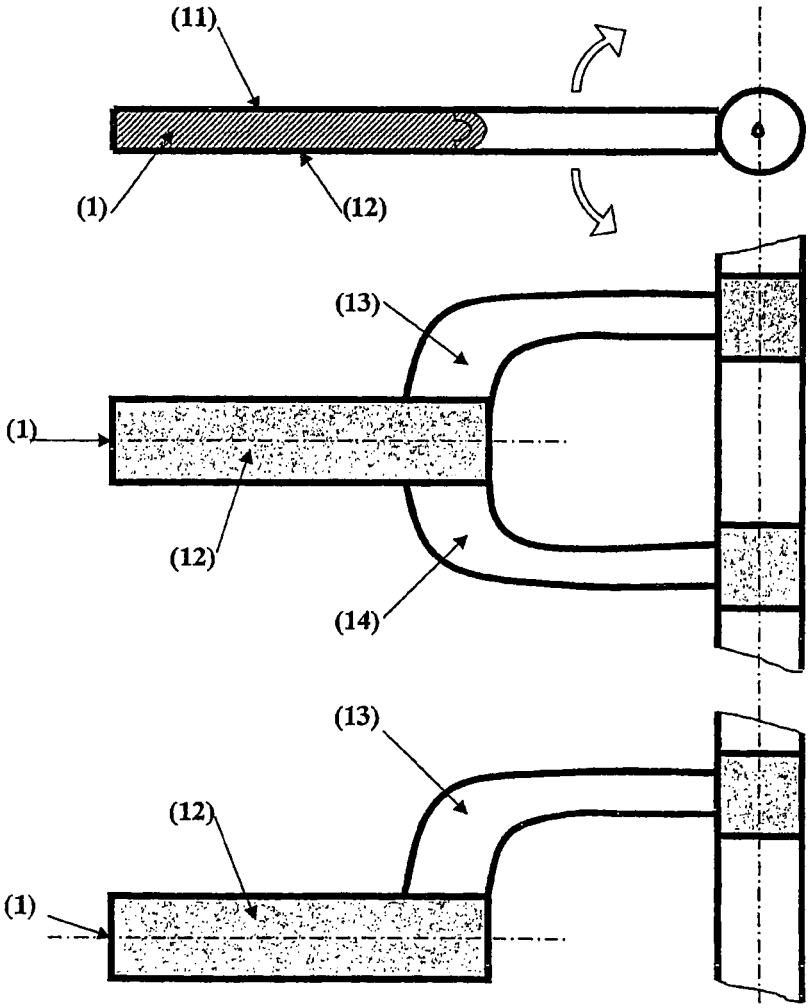
Figure 16:
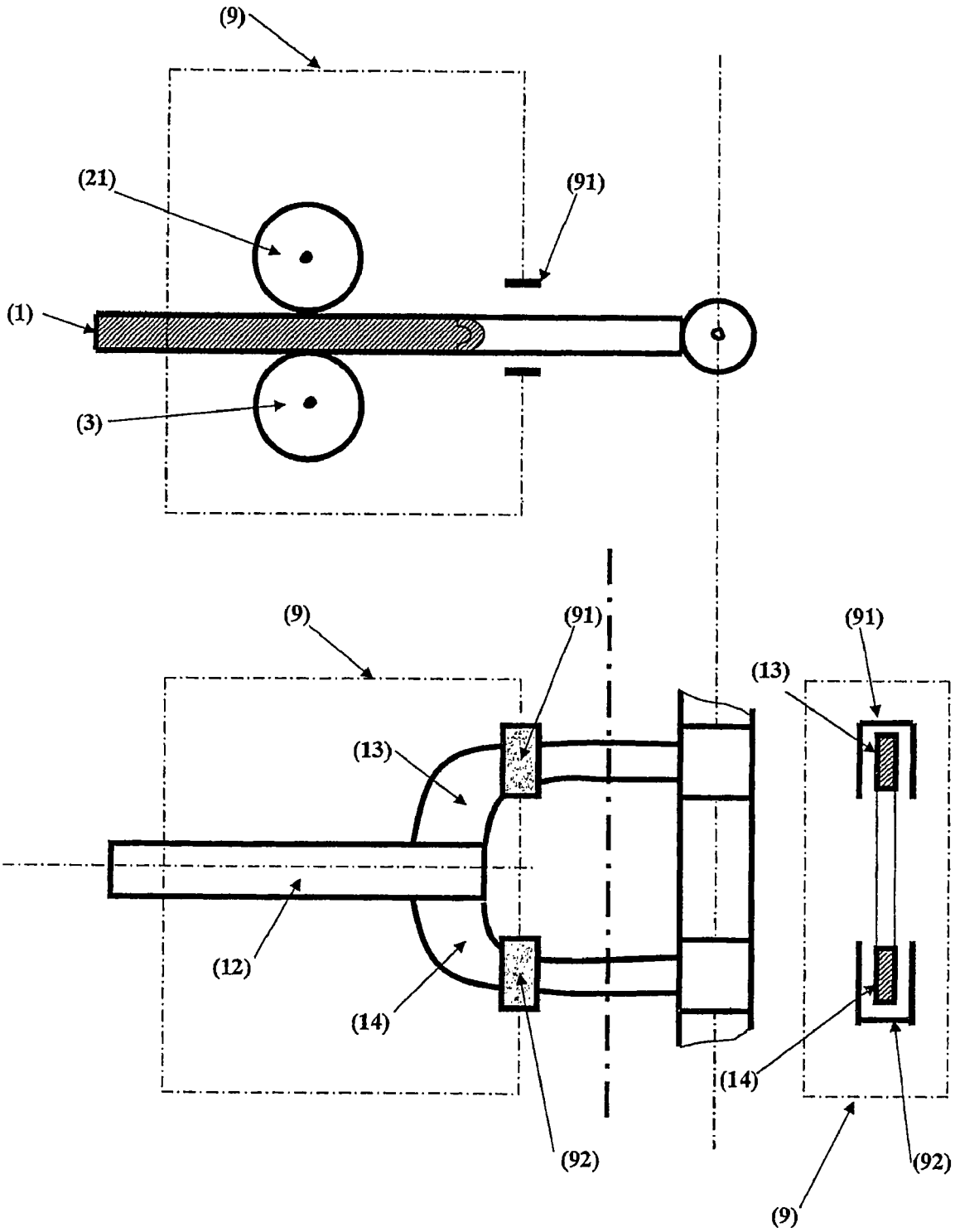

FIG. 14: variation of guiding arm (1) providing a defined zone of reduced contact FIG. 15: variation of guiding arm (1) providing a defined zone without any contact FIG. 16: schematic drawing showing sliding blocks (91) and (92)

Figure 17:
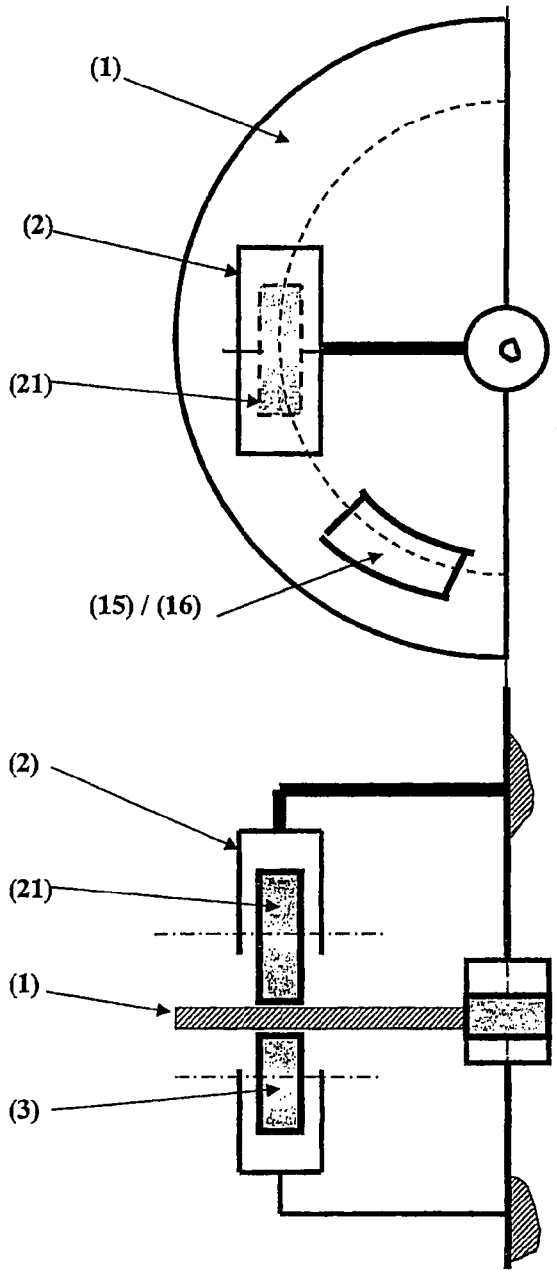

FIG. 17: variation of guiding arm (1)

Figure 18:
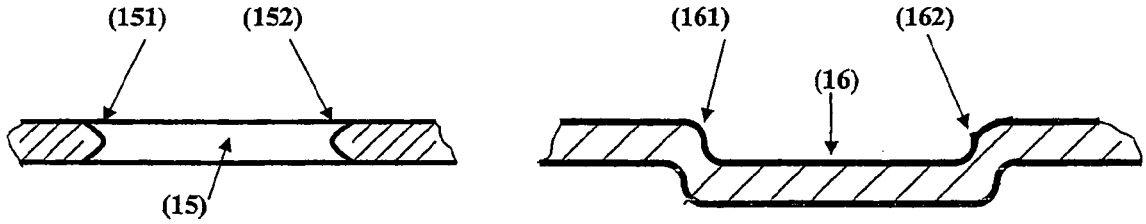

FIG. 18: detail from variation of guiding arm (1) as presented on FIG. 17

Figure 19:
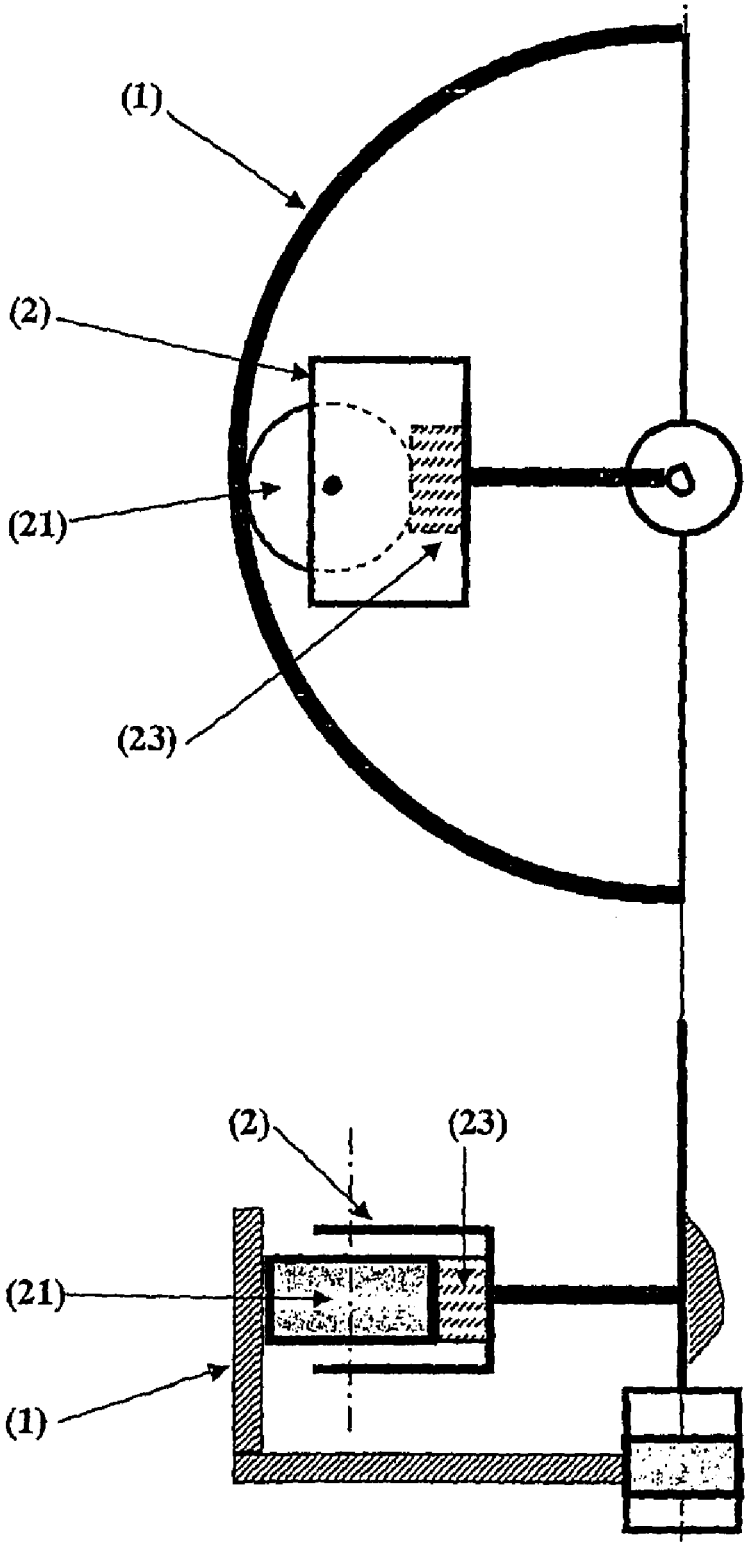

FIG. 19: other variation of guiding arm (1)

Figure 20:
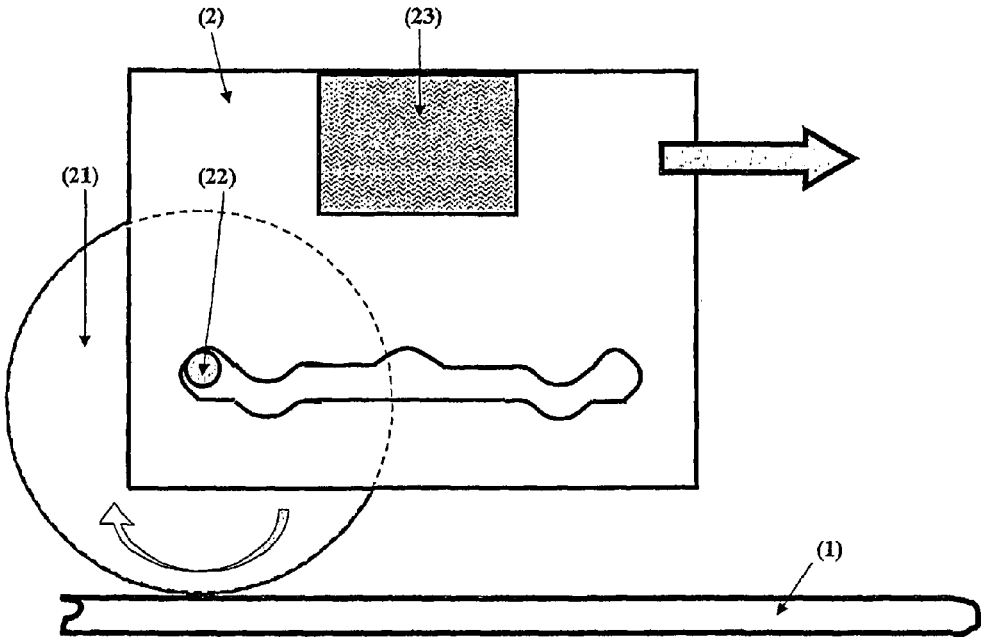
Figure 21:
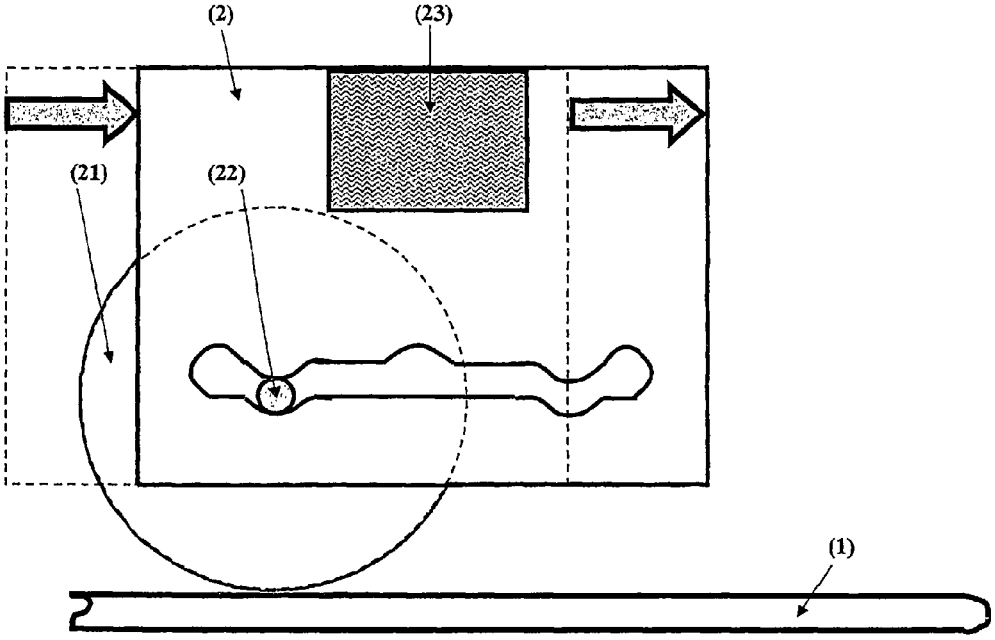

FIG. 20: illustration of operating principle of the mechanism in unlocked position FIG. 21: illustration of carriage device (2) deflection before unlocking The mechanism comprises: (FIG. 1)

An articulated guiding arm (1), formed by a metallic rod or any other resistant material, providing tracks on two opposite faces. This arm will be linked pivotably to one of the vehicle body and passenger door.

A mechanism (9), linked to one of the door and vehicle body, through which the guiding arm (1) will penetrate and whose purpose is to lock guiding arm (1) in any unpredefined stable position, as long as an operating load does not appear on the door which exceeds the unlock force.

Mechanism (9) comprises:

A carriage device (2) which comprises a braking roller (21), the said roller being partly made of materials having elastic properties, like elastomer or rubber utilized in tires for example, and which comprises a braking element (23). Braking element (23) will be made as a brake shoe linked to carriage device (2); one side (231) of the said brake shoe will come into contact with the rolling surface (211) of roller (21), in order to block it. (FIG. 1). Braking element (23) may be part of the body of carriage device (2). Roller (21) is mounted on axle (22), the said axle being intended to hold and guide roller (21) during its displacement relatively to the body of carriage device (2). This link between the carriage device and the roller is defined in such a way that a displacement between those elements occurs, whenever an operating load appears between guiding arm (1) and carriage device (2). This link can be realized simply by oblong slots (25) and (26), provided in the body of carriage device (2), slots inside which axle (22) can be guided and allowed a limited displacement. (FIG. 2). In locked position, roller (21) is blocked between braking element (23) and guiding arm (1), in such a way that the system formed by guiding arm (1)/carriage device (2) remains blocked. In order to simplify the assembly, carriage device (2) may be directly realized from folded metal sheets, as part of the passenger door or vehicle body. Spring device (24) as well as roller (3) and its axle (31), described hereafter, will in this case be directly linked to the door or vehicle body. A spring device (24), linked to carriage device (2), is made either of a flexible metallic or plastic element—for example a set of elastic blades, (FIG. 9), or is made of a system built with torsional springs, (FIG. 10)—the said spring device being intended to hold and bring back the axle (22) in the locked position. The spring device (24) will either act directly on the axle (22), or act on sliding blocks (224) and (223) as shown on FIG. 8. The said sliding blocks are as an option to improve the guiding of axle (22) along lateral openings (25) and (26). In this case, spring device (24) can, as a non limitative example, be composed of helicoidal spring elements providing a compression force.

A roller (3), mounted for free rotation on an axle (31) and assembled to a bracket (32), itself being linked to mechanism (9); the said roller is intended to counterbalance the load seen by guiding arm (1) from carriage device (2) (FIG. 1). For simplification or cost effectiveness, bracket (32) can be directly assembled to the door or to the vehicle body.

A simplified variation will consist into grouping bracket (32) and carriage device (2) to form a single part, itself linked to the door or to the vehicle body, as shown on FIG. 11. Bracket (32) is then no longer needed.

Guiding Arm (1)

Guiding arm (1), (FIG. 12), will be linked to the vehicle body, or to the passenger door, by the means of an articulation allowing sufficient freedom of movement to follow the door's displacement relative to the vehicle body during opening and closing maneuvers. The articulation will not be described herein and can be of any kind from the known art. Guiding arm (1) may be curved to cope with the cinematic constraints resulting from the displacement of the door during opening and closing maneuvers. Guiding arm (1) may be formed in a way to offer several notches or bosses if preferred positions are requested. Guiding arm (1) may be formed as to offer two tracks, (11) and (12), located on opposite faces, one of which will constitute a blocking area (11), and will therefore be designed to provide a braking adherence between guiding arm (1) and roller (21). In this regard, the adherence between guiding arm and roller may result from surface roughness on track (11), or by any kind of notching, or gearing, matching the exterior shape of roller (21). Track (12), located on the opposite face, will act as a guide for roller (3). Cross section of guiding arm (1) may be designed with any shape, for example circular, elliptic, . . . , knowing that a rectangular cross section appears to be among the simplest and cost effective and will therefore be used in all schematic drawings. Nevertheless, this cross section may be designed in order to improve the drive of roller (21), as well as guiding and blocking performance, as illustrated in examples shown on FIG. 13, like U, V or reverse V shapes, double railroad shape, . . . . Accordingly, cross section of roller (21) will, in each case, match the cross section of the guiding arm. In addition, cross section of guiding arm (1) may vary, depending on adherence or rolling characteristics requested, these parameters being essential to tune the functionalities required in the technical specifications: load needed on the door during opening or closing maneuvers, with an option to predefine positions with reduced resistance. Specifically, at the position where the door opening initiates, the cross section of the guiding arm may be narrowed, (FIG. 14), and the surface of track (11) may allow roller (21) to slide, in order to inhibit any locking in this area. In this regard, some parts of track (11) may be covered with a low friction material, like Teflon, surface treatment, . . . .

Guiding arm (1) may also be realized as indicated on FIG. 15, with two branches (13) and (14), or only one branch (13), in such a way that roller (21) encounters a portion of the guiding arm where it has no possible contact with track (11). This arrangement will essentially be used in the positions corresponding to the initial phases of opening—or end of closing of the door. Mechanism (9) will in this case be fitted with sliding blocks (91) and (92), shown schematically on FIG. 16, intended to guide branches (13) and (14) and ensuring a smooth connection between rollers (21) and (3), and guiding arm (1) during door maneuvers. Sliding blocks (91) and (92) will not be detailed herein, but will be shaped in a way that they mostly match the cross sections of branches (13) and (14), and in order to allow low friction. A variation may consist of having sliding blocks (91) and (92) directly mounted on the door frame or vehicle body.

Finally, the guiding arm (1) may be curved at its free end, as illustrated on FIG. 12, in order to provide a stop for roller (3)—or for roller (21)—providing, in such a way, a limiting device for the fully open position of the door.

Variation: guiding arm (1) may be realized with a rigid plate linked to the vehicle body—or to the door, with which roller (21) will be in contact. (FIG. 17). Roller (3) may be kept to counterbalance the load generated by roller (21). However, if guiding plate (1) is sufficiently rigid, roller (3) will become useless. During the door maneuvers, in opening or closing, roller (21) will move along an approximate circular path, centered on the axis of the door hinges. Some slots (15) or bosses (16), may be provided on the path of roller (21), in order to suppress the locking function in some given positions. (FIG. 18). The shapes given to the connecting areas (151)-(152) or (161)-(162), will be designed in order to provide a smooth ride of roller (21) along its path.

Other variation for the guiding arm: guiding arm (1) may be realized with a cylindrical element linked to the vehicle body—or to the door, with which roller (21) will be in contact. (FIG. 19). Roller (3) should normally not be needed to counterbalance the load generated by roller (21). During the door maneuvers, in opening or closing, roller (21) will move along an approximate circular path, centered on the axis of the door hinges. Some slots or bosses may, as in the previous variation, be designed on the path of roller (21) in order to suppress the locking function in some given positions.

Carriage Device (2)

The shape of carriage device (2) will be shown here as a schematic drawing and may be optimized to fulfill the requirements of each specific application, essentially to match the geometric constraints imposed by its environment. (FIG. 2).

Carriage device (2) may be realized from metal, plastic or synthetic material, and will be used as a rigid frame to link the parts that are connected to it. The said carriage device may be obtained by cast, molding, forging, stamping, or any other conventional process. Carriage device (2) is linked to the door or to the vehicle body by any conventional means, like screwing, bolting, crimping, soldering, . . . .

Carriage device (2) comprises (FIG. 1):

A/ A Braking Roller (21)

Braking roller (21), mounted on its axle (22), is designed with an approximately cylindrical shape, made of a material allowing an elastic deformation, like elastomer, rubber or material utilized to produce tires, . . . . Roller (21) is intended to provide a blocking force between guiding arm (1) and mechanism (9). Roller (21) will be made of a more or less soft material, in order to allow an elastic deformation providing a slight rolling resistance during the opening or closing of the door. The material utilized for the rolling surface (211) of roller (21), if different from the material utilized for the body of the roller, will be chosen to allow enough friction along the guiding arm (1) as well as a durability level in conformance with technical specifications requested. The rolling surface (211) of roller (21) may be bald, or carved in a way to ensure the best adherence to the rolling path (11). The rolling surface (211) may include notches of any type, corresponding to assorted notches on the rolling path (11) of guiding arm (1). In addition, the cross section of rolling surface (211) will be shaped in accordance with the cross section of rolling path (11), (FIG. 13), in order to optimize the guiding of roller (21) along the guiding arm (1).

Roller (21) may be assembled in a way to allow a free rotation around its axle, or on the contrary in a way that the roller is fixed to its axle. The choice between either solution will be driven by cost and/or durability considerations. Axle (22) may be axially secured in regard to carriage device (2), by any conventional means: washer and circlip or stop bolt on both sides of carriage lateral slots, bosses on the axle, not illustrated in the enclosed figures. In the case where axle (22) is fixed to roller (21), the said roller being <<trapped >> inside carriage device (2), there might be no need for any axial link. In this case, it might be useful to have lateral pads (212)-(213) on both sides of roller (21), in order to reduce friction forces between the roller and the lateral faces of carriage device (2). (FIG. 3).

B/ A Braking Element (23):

Braking element (23) will be made as a brake shoe linked to carriage device (2). One side (231) of the said brake shoe will come into contact with the rolling surface (211) of roller (21), in order to block it. (FIG. 1). The surface (231) of braking element (23) will provide some adherence with rolling surface (211) of roller (21), the said adherence may be obtained by surface roughness or by any kind of notching, even a gearing, matching with the rolling surface of roller (21). The braking element (23) may be made of a material providing enough adherence in relation with the material used for roller (21), like for example metal, plastic, elastomer, . . . . The braking element (23) may be part of the body of carriage device (2), to form a single part obtained by moulding, or by stamping and folding of metallic parts or by any other processes known from the present art.

C/ Lateral Guiding Slots (25) and (26): (FIG. 2)

Lateral guiding slots (25) and (26), enclosed on the body of carriage device (2), are intended to hold and guide axle (22) of roller (21), specifically during door opening or closing maneuvers. These lateral guiding slots will be shaped in such a way that they include notches and bosses, intended to produce effects described hereafter. (FIG. 4). According to the invention, axle (22) moves inside the lateral guiding slots (25) and (26). For this purpose, sliding blocks (223) and (224), may possibly be mounted on to the ends of axle (22), in order to improve the guiding and the durability of the parts. (FIG. 8). These sliding blocks may be made of a low friction material in accordance with the material which the body of carriage device (2) is made of. Lateral guiding slots (25) and (26) may be obtained by any conventional process from the present art, for example by stamping in the case of a metallic part or by injection moulding in the case of a plastic part. In addition, the areas being in contact with axle (22) or with sliding blocks (223)-(224), may have surface treatment to prevent premature wear. For this purpose, the lateral guiding slots (25) and (26) may be covered with some material providing low friction and improved durability for the mechanism.

The unlocking is obtained by releasing roller (21) relatively to guiding arm (1):

When a load is applied between guiding arm (1) and carriage device (2), during door opening or closing maneuvers, axle (22) tends to leave the central lock position, materialized by notches (250) and (260) as shown on FIG. 4. Axle (22) then tends to slide along lateral guiding slots (25) and (26), in a direction opposite to the direction of the load. (FIG. 21). When axle (22) passes the bosses, respectively (251)-(261) or (252)-(262), depending on the direction, the braking roller (21) is released from the braking element (23), which allows a free rotation of roller (21) and consequently a relative displacement between carriage device (2) and guiding arm (1). The bosses, respectively (251)-(252) and (261)-(262), provided on lateral guiding slots (25) and (26), are intended to resist to the displacement of axle (22) during opening and closing maneuvers, allowing to calibrate the load needed to unlock the mechanism as well as to define the clearance between locked and unlocked positions as requested for the door. (FIGS. 4 and 20). The slopes, respectively (2511)-(2512), (2521)-(2522), (2611)-(2612) and (2621)-(2622) of bosses (251), (252), (261) and (262), may be slightly asymmetrical, in order to differenciate the locking and unlocking loads. (FIG. 4). One will notice that the elasticity of roller (21) constituent material has an impact on the calibration of the unlocking force, roller (21) being slightly <<crushed>> against guiding arm (1), when axle (22) passes over bosses, respectively (251)-(261), or (252)-(262). The lateral guiding slots (25) and (26) will also include notches, respectively (253)-(254) and (263)-(264) intended to receive axle (22) during opening and closing maneuvers. This provides a resistance to counterbalance the load generated by the spring device (24). The load produced by the spring device (24) on axle (22) when positioned inside two of notches (253)-(263) or (254)-(264), is also partly counterbalanced by the rolling resistance of roller (21) along guiding arm (1). As soon as the load driving carriage device (2) along guiding arm (1) disappears, the spring device (24) tends to extract axle (22) from notches respectively (253)-(263) or (254)-(264), to bring the said axle back into the initial locked position, inside notches (250) and (260). Roller (21) is then again blocked between braking element (23) and guiding arm (1), ensuring a retaining force between carriage device (2) and guiding arm (1). This re-locking operation, will take place within a limited clearance, from the point where the opening or closing load was interrupted. This clearance may be defined by the size of lateral guiding slots (25) and (26). It is then easy to obtain any stable position for the door, chosen during an opening or closing maneuver. The wedging of the door appears automatically as soon as the load needed to open or close the door is interrupted, with no need to look for a predefined locking position.

Variation: in order to reinforce the stability of roller (21) in <<unlocked >> positions, it may be considered to place permanent magnets, or any other material with magnetic properties, (255), (256), (265), (266), just beside notches respectively (253), (254), (263), (264). (FIG. 5). The way the magnets are mounted is not described herein, but may be realized by any conventional means: crimping, gluing, screwing, or other. In this case, axle (22) of roller (21) will necessarily be made of some material having magnetic properties: metal, magnetic material. An additional option, may be to add parts (221) and (222), with magnetic properties, on to the ends of axle (22), as shown in FIG. 6, in a way that parts, respectively (221) and (222), move to face permanent magnets (255) and (265), or (256) and (266) respectively.

A variation may be to realize parts (221) and (222) in some material having magnetic properties and to place some blocks (257), (258), (267) and (268), beside notches respectively (253), (254), (263) and (264). (FIG. 7). The blocks (257), (258), (267) and (268), may be realized with the same material as the body of carriage device (2), provided the said body is made of some material having magnetic properties. The blocks (257), (258), (267) and (268), may be, for example, realized by simply cutting and bending a part of lateral faces of carriage device (2).

D/ A Spring Device (24)

A spring device (24), linked to carriage device (2), is intended to hold or to bring back axle (22) into its normal <<rest>> position, with roller (21) blocked against braking element (23). This spring device (24) may be realized with flexible metallic or plastic blades, acting directly on axle (22), as shown on schematic drawings in FIGS. 9 and 10. The spring device (24) may also act indirectly by the means of sliding blocks (223) and (224) (FIG. 8). Spring device (24) may then, for example but not exhaustively, be realized with one or several coil springs, or laminated springs, or realized with an elastic block as elastomer.

Roller (3)

Roller (3) will be intended to counterbalance the load seen on guiding arm (1) from carriage device (2), allowing guiding arm (1) to be held during its displacement through mechanism (9). (FIG. 1). Roller (3) will rotate freely on its axle (31). Axle (31) will be mounted on bracket (32), itself linked to carriage device (2), or axle (31) may otherwise be directly linked to a part of the door or of the vehicle body. Axle (31) will be axially secured on bracket (32) by any conventional means circlip, pin, boss on the axle, not illustrated on the enclosed figures.

The invention claimed is:

1. A door check mechanism providing an infinite number of stable retaining positions between fully opened and closed, said mechanism comprising:

a guiding arm linked to a steady part, or linked to a moving part; and a mechanism linked to the opposite of the steady or moving part, in such a way that the guiding arm penetrates through the mechanism with a relative displacement between those two parts, the checking function being provided by a relative blocking of the guiding arm through said mechanism, wherein the guiding arm provides a rolling and relative blocking path between said guiding arm and said mechanism, whereas the surface of rolling path provides appropriate roughness to ensure the adherence of a braking roller to said guiding arm, the braking roller being configured to ensure a checking function, the surface of the rolling path may therefore enclose notches that will match the shape of a rolling surface of the braking roller, the braking roller being made of an elastic material;

the mechanism includes a carriage device which comprises the braking roller mounted on an axle which can slide along lateral guiding slots, which are provided on the sides of said carriage device, whereas a braking element made of a brake shoe linked to carriage device will block the braking roller by a contact between its surface and the braking roller and whereas a spring device acting on said axle, while the load exerted on the guiding arm by the braking roller is counterbalanced by a roller mounted to the opposite of the braking roller, which holds the guiding arm, the mechanism ensuring the three functions hereafter:

a) blocking of the rotation of the braking roller against guiding arm in any un-predefined position, b) release of the rotation of the braking roller whenever an opening or closing force greater than a predefined release threshold is exerted on the door, this release taking place within a limited clearance between the mechanism and the guiding arm, c) automatic re-locking, in any un-predefined position of the door, when the opening or closing force disappears;

the lateral guiding slots, comprising bosses and notches, which resist the displacement of the axle, and which provide stable positions, during a locked phase and opening or closing maneuvers, the bosses and notches configured so during door opening or closing maneuvers, the axle tends to slide along lateral guiding slots in a direction opposite of the direction of the load, and after a limited clearance, the axle passes the bosses and reaches the notches, which releases the braking roller from the braking element, allowing its free rotation and therefore a relative displacement between the carriage device and the guiding arm; whereas the spring device exerts a compression load on the axle tending to bring it back to the locked position, as soon as the opening or closing maneuver is interrupted, the clearance of the door during this re-locking phase being limited by the size of lateral guiding slots.

2. The door check mechanism as described in claim 1, wherein the bracket of the roller is part of the carriage device, forming a single part.

3. The door check mechanism as described in claim 1, wherein magnets are placed near the lateral guiding slots, or are placed on the axle, in order to improve the stability of axle when positioned in the notches during the opening or closing of the door.

4. The door check mechanism as described in claim 1, wherein the cross section of the surface of the braking roller may have various shapes, like U, V or double railroad type, in order to improve the guiding of the braking roller along the rolling path of guiding arm, the guiding arm being therefore shaped accordingly.

5. The door check mechanism as described in claim 1, wherein the guiding arm comprises one or two branches in such a way that the braking roller encounters a portion of the rolling path where they are not in contact, in order to prevent any checking function within said portion, whereas the branches may therefore be guided by sliding blocks.

6. The door check mechanism as described in claim 1, wherein the guiding arm is attached with a rigid plate to the steady or moving part, with which the braking roller will be in contact, and whereas the braking roller will move along an approximately circular path centered on the axis of the movement between the steady and moving parts.

7. The door check mechanism as described in claim 1, wherein the guiding arm is attached with a cylindrical part to the steady or moving part with which the braking roller will be in contact, and whereas the braking roller will move along an approximately circular path centered on the axis of the movement between the steady and moving parts.

* * * * *